US007745748B2

(12) United States Patent
Ingerslev Nielsen et al.

(10) Patent No.: US 7,745,748 B2
(45) Date of Patent: Jun. 29, 2010

(54) SWITCH HAVING A COMPLEMENTARY DIODE UNIT

(75) Inventors: Jens Ejner Ingerslev Nielsen, Hvidovre (DK); Claus Enoch, Køge (DK)

(73) Assignee: MEC A/S (DK)

( * ) Notice: Subject to any disclaimer, the term of this patent is extended or adjusted under 35 U.S.C. 154(b) by 0 days.

(21) Appl. No.: 11/816,146

(22) PCT Filed: Feb. 7, 2006

(86) PCT No.: PCT/DK2006/000063

§ 371 (c)(1),
(2), (4) Date: Dec. 19, 2008

(87) PCT Pub. No.: WO2006/086981

PCT Pub. Date: Aug. 24, 2006

(65) Prior Publication Data

US 2009/0178904 A1 Jul. 16, 2009

(30) Foreign Application Priority Data

Feb. 15, 2005 (DK) ..... 2005 00227

(51) Int. Cl.
*H01H 9/00* (2006.01)

(52) U.S. Cl. ..... 200/314; 200/345

(58) Field of Classification Search ..... 200/310–314, 200/341–345

See application file for complete search history.

(56) References Cited

U.S. PATENT DOCUMENTS

| | | | |
|---|---|---|---|
| D209,513 | S | 12/1967 | Walters et al. |
| 3,805,004 | A | 4/1974 | Kondo et al. |
| 3,849,621 | A | 11/1974 | Habecker |
| 3,934,105 | A | 1/1976 | Lockard |

(Continued)

FOREIGN PATENT DOCUMENTS

| | | | |
|---|---|---|---|
| CN | 2488156 | Y | 4/2002 |

(Continued)

OTHER PUBLICATIONS

International Search Report for Application No. PCT/DK2006/000063.

(Continued)

*Primary Examiner*—Renee Luebke
*Assistant Examiner*—Lisa Klaus
(74) *Attorney, Agent, or Firm*—Knobbe Martens Olson & Bear LLP

(57) ABSTRACT

A diode unit (9) including at least one diode (13) and a pair of terminals (15) is mounted on a switch body (2) having an actuate-able key (6) and at least two terminal points (4). The diode unit (9) is positioned on the exposed end of the key (6) such that surface parts of the diode unit (9) is brought into engagement with corresponding surface parts of the switch body (2) so as to prevent the diode unit (9) from movement in relation to the switch body (2) in a predefined plane. The diode unit terminals (15) extend in a direction transverse to said plane, and the diode unit terminals (15) are connected to the terminal points (4) of the switch body (2) so as to prevent movement of the diode unit (9) in relation to the switch body (2) transversely to said predefined plane.

12 Claims, 5 Drawing Sheets

U.S. PATENT DOCUMENTS

| | | | | |
|---|---|---|---|---|
| 4,370,533 | A | 1/1983 | Kamei et al. | |
| 4,433,222 | A | 2/1984 | Kodaira | |
| 4,445,164 | A | 4/1984 | Giles, III et al. | |
| 4,532,393 | A | 7/1985 | Koizumi et al. | |
| 4,663,601 | A | 5/1987 | Troutman et al. | |
| 4,772,769 | A | 9/1988 | Shumate | |
| 4,874,913 | A | 10/1989 | Aoki et al. | |
| 5,199,557 | A | 4/1993 | Brandt et al. | |
| 5,750,947 | A | 5/1998 | Rao et al. | |
| 6,359,243 | B1 | 3/2002 | Nakade et al. | |
| 6,900,403 | B2 | 5/2005 | Ruegenberg | |
| 7,235,754 | B2 * | 6/2007 | Rochon et al. | 200/406 |
| 2004/0074751 | A1 | 4/2004 | Watanabe | |
| 2005/0263381 | A1 | 12/2005 | Bouvier et al. | |
| 2006/0016672 | A1 | 1/2006 | Lee | |
| 2006/0124438 | A1 | 6/2006 | Bader et al. | |
| 2007/0029176 | A1 | 2/2007 | Sakurai | |

FOREIGN PATENT DOCUMENTS

| | | | |
|---|---|---|---|
| DE | 150 519 | | 9/1981 |
| DE | 34 47 622 | A1 | 10/1985 |
| DE | 199 16 795 | C1 | 8/2000 |
| FR | 2 517 846 | | 12/1981 |
| JP | 05-182560 | | 7/1993 |
| JP | 05182560 | A * | 7/1993 |
| JP | 2001184974 | A | 7/2001 |
| WO | WO 2004/064094 | | 7/2004 |

OTHER PUBLICATIONS

Written Opinion of the International Searching Authority for Application No. PCT/DK2006/000063.

International Preliminary Report on Patentability for Application No. PCT/DK2006/000063.

* cited by examiner

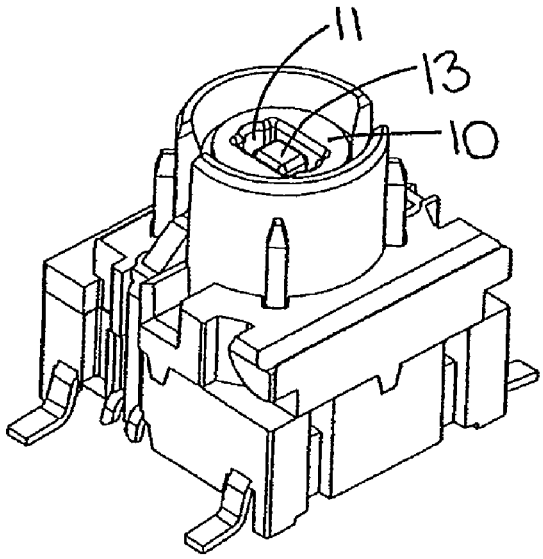
Fig. 2a
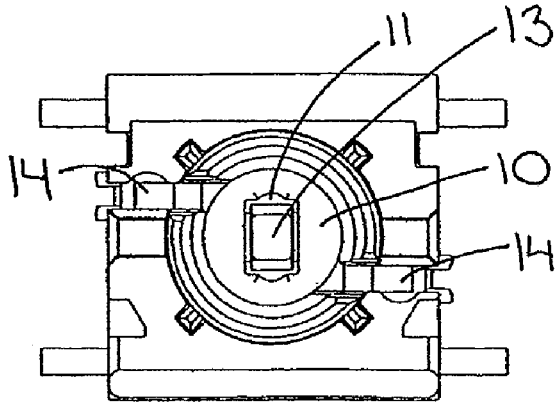
Fig. 2b
Fig. 2

Fig. 4a
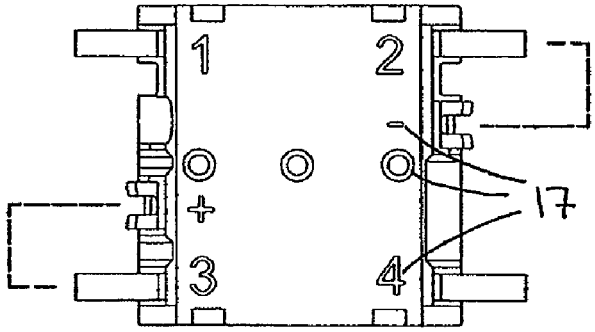
Fig. 4b
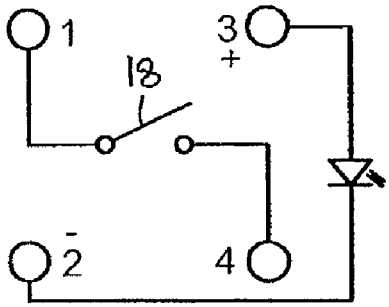
Fig. 4c
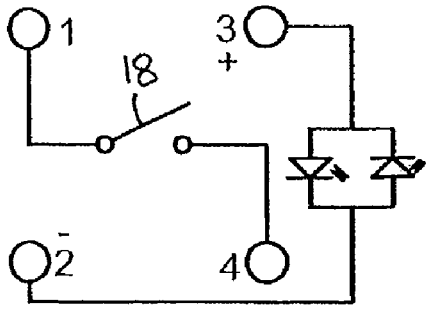
Fig. 4

SWITCH HAVING A COMPLEMENTARY DIODE UNIT

CROSS REFERENCE TO RELATED APPLICATION

This application claims the benefit and priority to and is a U.S. National Phase of International Application No. PCT/DK2006/000063, filed on Feb. 7, 2006, designating the United States of America and published in the English language, which claims priority under 35 U.S.C. §119 to Danish Patent Application Number PA 2005 00227, filed on Feb. 15, 2005. The disclosures of the above-referenced applications are hereby expressly incorporated by reference in their entireties.

The present invention relates to a switch and particularly to a switch comprising a complementary diode unit mounted thereon. The switch may e.g. be of the type disclosed in U.S. Pat. No. 5,199,557.

BACKGROUND OF THE INVENTION

Electronic switches are available in a range of versions depending on the actual application, the manufacturing methods used, etc. U.S. Pat. No. 5,199,557 discloses different designs of switches comprising one or more diodes mounted thereon. The switch is intended to be mounted e.g. in a keyboard panel by the so-called the Surface Mounting Technique (SMT). However, the diodes cannot withstand this process wherein the tin may be heated for e.g. 240° C. for approximately 60 seconds, and they are therefore mounted afterwards. The diode is mounted in a socket received in the inner space of a push button extender, and the diode terminals extend through slits of the push button extender and further through apertures of the housing component of the switch.

SUMMARY OF THE INVENTION

It is an objective of the present invention to provide a switch that can be manufactured in an automatic process without the need for later mounting of the one or more diodes, and to provide a method of making such switch.

An aspect of the present invention relates to a method of mounting a diode unit including at least one diode and a pair of terminals on a switch having an actuate-able key and a switch body with at least two terminal points, said method comprising positioning the diode unit on the exposed end of the key such that surface parts of the diode unit are brought into engagement with corresponding surface parts of the switch body so as to prevent the diode unit from movement in relation to the switch body in a predefined plane, extending the diode unit terminals in a direction transverse to said plane, and connecting the diode unit terminals to the terminal points of the switch body so as to prevent movement of the diode unit in relation to the switch body transversely to said predefined plane.

The method may ensure a secure fastening of the diode and thereby an easy-to-handle switch which is ready for mounting e.g. in a keyboard panel without the need for later mounting of the diode(s). If the switch is mounted with SMT-technique or another mounting technique involving heating, it is necessary to use diodes that are resistant to the temperatures involved.

In a presently preferred embodiment of the invention, the diode unit is arranged within a recess formed in the exposed end of the key and defined by a surrounding peripheral wall, the diode unit terminals extending through openings or slits formed in said peripheral wall. The recess may have any shape which allows arrangement of the actual diode unit according to the invention. It may e.g. have the same shape as the outer geometry of the diode unit to be placed therein. The cross section of the recess may be substantially circular, or it may have any other shape such as substantially rectangular.

The diode(s) may be mounted in a socket having projections including said diode unit terminals, said projections being arranged so as to extend though said openings or slits formed in the peripheral wall of the key. The shape of the socket may be substantially circular, or it may have any other shape such as substantially rectangular. The clearance between the diode unit and the key is preferably so as to allow actuation of the key without influencing the diode unit.

The connecting of the diode unit terminals to the terminal points of the switch body preferably comprises the steps of mechanically interconnecting the diode unit terminals and the terminal points of the switch, and soldering the connection between the diode unit terminals and the terminal points of the switch. The mechanical interconnection ensures that the diode unit is kept in the right position even if the mounting of the switch includes heating. The soldering may enhance the electrical connection between the diode unit terminals and the terminal points of the switch body, and it may furthermore improve the securing of the diode unit during handling of the switch.

Each terminal point of the switch body preferably comprises a pair of slightly mutually spaced terminal pins, said connecting of the diode unit terminals comprising positioning each diode unit terminal between a respective pair of said terminal pins, and pressing the pins together around the diode unit terminals. However, each terminal point may also comprise only one terminal pin or three or more terminal pins. The step of mechanically interconnecting the diode unit terminals and the terminal points of the switch body may also include twisting or bending the terminal pins.

Another aspect of the invention relates to a switch comprising a switch body having at least two terminal points, and an actuate-able key mounted on said switch body and having a diode unit including at least one diode and a pair of terminals mounted on the exposed end of the key, surface parts of the diode unit engaging with corresponding surface parts of the switch body so as to prevent the diode unit from movement in relation to the switch body in a predefined plane, the diode unit terminals extending in a direction transverse to said plane and being connected to the terminal points of the switch body.

The diode unit is preferably arranged within a recess formed in the exposed end of the key and defined by a surrounding peripheral wall, the diode unit terminals extending through openings or slits formed in said peripheral wall. The key may have any shape, such as having a substantially circular or rectangular cross section. The peripheral wall may have a cylindrical outer surface, i.e. the key has a substantially constant cross section along its height, or the cross section may vary.

The diode(s) is/are preferably mounted In a socket having projections including said diode unit terminals, said projections being arranged so as to extend though said openings or slits formed in the peripheral wall of the key. The diode(s) is/are preferably mounted in a cavity formed in the socket. They may be mounted e.g. by gluing or soldering.

In a presently preferred embodiment of the invention each terminal point of the switch body comprises a pair of slightly mutually spaced terminal pins, each terminal of the diode unit being positioned and pinched between a respective pair of said terminal pins.

The engaging surface parts of the diode unit and the switch body, respectively, may preferably comprise substantially complementary surface parts.

The switch body may further comprises at least four terminal components extending outwards from one or more outer side wall(s) of the switch body, at least two of the terminals each being electrically connected to a respective terminal point. The terminal components may be placed on one, two or more sides of the switch body. They are preferably adapted to be mounted on a plane surface

BRIEF DESCRIPTION OF THE DRAWINGS

In the following, preferred embodiments of the present invention will be described in details with reference to the accompanying figures in which:

FIG. 2*a* is a perspective view of the switch shown in FIG. 1, and FIG. 2*b* is a top plane view of the switch. The switch in FIGS. 2*a* and 2*b* is shown as having one diode.

FIG. 4*a* is a bottom plane view of the switch shown in FIG. 1. FIGS. 4*b* and 4*c* are diagrams of the electrical connections of switches having one and two diodes, respectively.

DETAILED DESCRIPTION OF PREFERRED EMBODIMENTS

Figure 1:
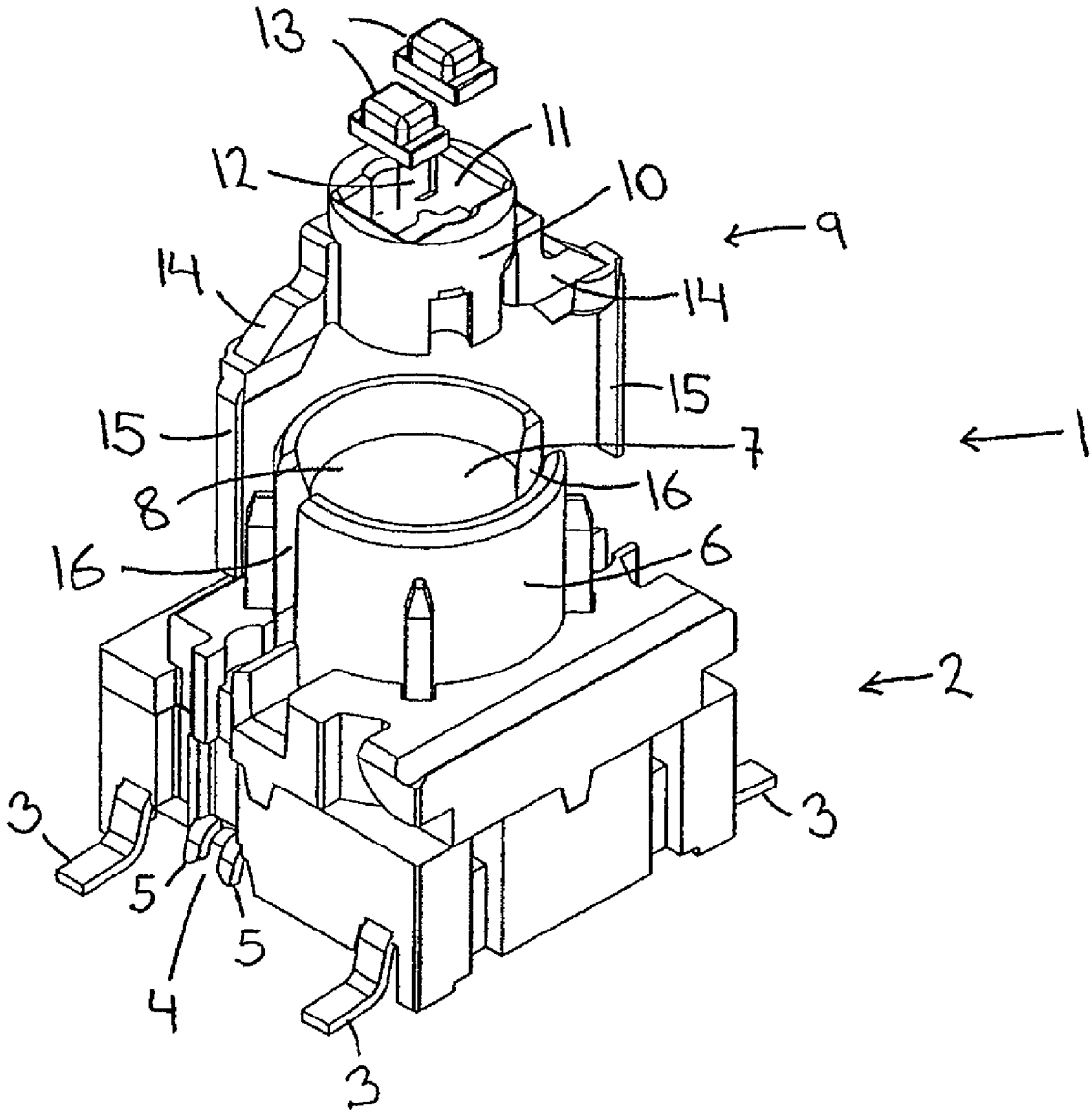
FIG. 1 is an exploded view of the switch illustrating a switch body and a diode unit to be mounted on the switch body.

FIG. 1 illustrates a preferred embodiment of a switch 1 according to the invention in which the switch body 2 has four terminal components 3, three of which are visible in the figure. The switch body 2 further comprises two terminal points 4 (only one of them Is visible In the figure) positioned at opposite sides of the switch body 2. In the preferred embodiment shown, each terminal point 4 comprises a pair of slightly mutually spaced terminal pins 5. The switch 1 further comprises an actuate-able key 6 which when actuated moves along its axis of symmetry. The key 6 has a recess 7 formed in the exposed end of the key which recess 7 is defined by a surrounding peripheral wall 8.

The diode unit 9 has a socket 10 with a cavity 11 comprising contacts 12 for the diode(s) 13 and projections 14 each including one of the diode unit terminals 15. The projections 14 are arranged so as to extend though slits 16 formed in the peripheral wall 8 of the key 6. At least one diode 13 is/are mounted in the cavity 11 of the socket 10 in electrical connection with the contacts 12. The switch 1 according to the present invention is preferably adapted to be used with light-emitting SMD-diodes, but it is possible to use any type of diode suitable for the actual application and mountable in a diode unit according to the invention.

Figure 3:
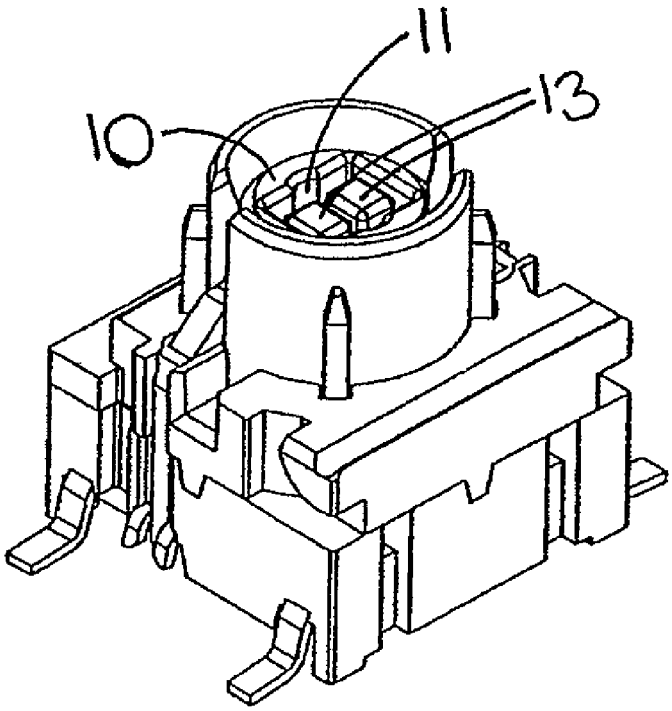
FIG. 3 is a perspective view of the switch shown in FIG. 1. The switch is shown as having two diodes.

FIGS. 2*a* and 2*b* show a switch with one diode 13, and FIG. 3 shows an embodiment with two diodes 13. It may also be possible to use three or more diodes for the switch provided that there is enough space in the cavity 11 of the socket 10. FIGS. 2 and 3 show two different shapes of the cavity 11 for mounting of the diode(s) 13. The sizes of the cavities 11 shown may be adjusted to the size(s) of the diode(s) 13. The shape of the cavity 11 may therefore be of any shape adapted to receive a desired type and size of diode 13. However, it may also be possible to use diode units 9 having a socket 10 with a cavity 11 adapted to receive a varying number of diodes for the same cavity geometry and size. FIG. 2*b* is a top plane view of the switch in FIG. 2*a* which illustrates a preferred embodiment of the invention. The projections of the diode unit 14 may also extend from other positions of the socket 10, such as symmetrically from the socket 10. For such embodiments it is necessary to use a complementary geometry of the switch body. FIGS. 2 and 3 illustrate preferred embodiments of the invention in which the geometry of the diode unit makes it possible to mount the diode unit in any of the two possible directions. The electrical circuit of the whole switch is then determined by the polarisation of the diode(s) 13. However, it may also be possible to have diode units 9 that have to be mounted in one predetermined way. The right mounting must then be ensured e.g. by indications on the switch or by using a geometry that restricts the possible ways of mounting.

FIG. 4 illustrates a preferred way of making the electrical connections in a switch. FIG. 4*a* is a top plane view of a switch, and FIGS. 4*b* and 4*c* are diagrams of the electrical connections of switches having one and two diodes, respectively. The signs 17 shown on the switch body in FIG. 4*a* are examples of possible markings aimed at guiding the mounting of the switch e.g. in a keyboard panel. The numbers shown correspond to the numbers of the terminal components shown in FIGS. 4*b* and 4*c*. The contact members 18 in the middle of FIGS. 4*b* and 4*c* indicate actuating the key. As illustrated In FIG. 4*a*, terminal component 2 is electrically connected to one of the terminal point (marked as −), and terminal component 3 is electrically connected to the other terminal point (marked as +). However, other possible connections between the terminal components and the terminal points will also be possible within the scope of the invention. These connections may e.g. be established by producing all the terminals used for a switch body from one piece of electrically conductive material.

Figure 5:
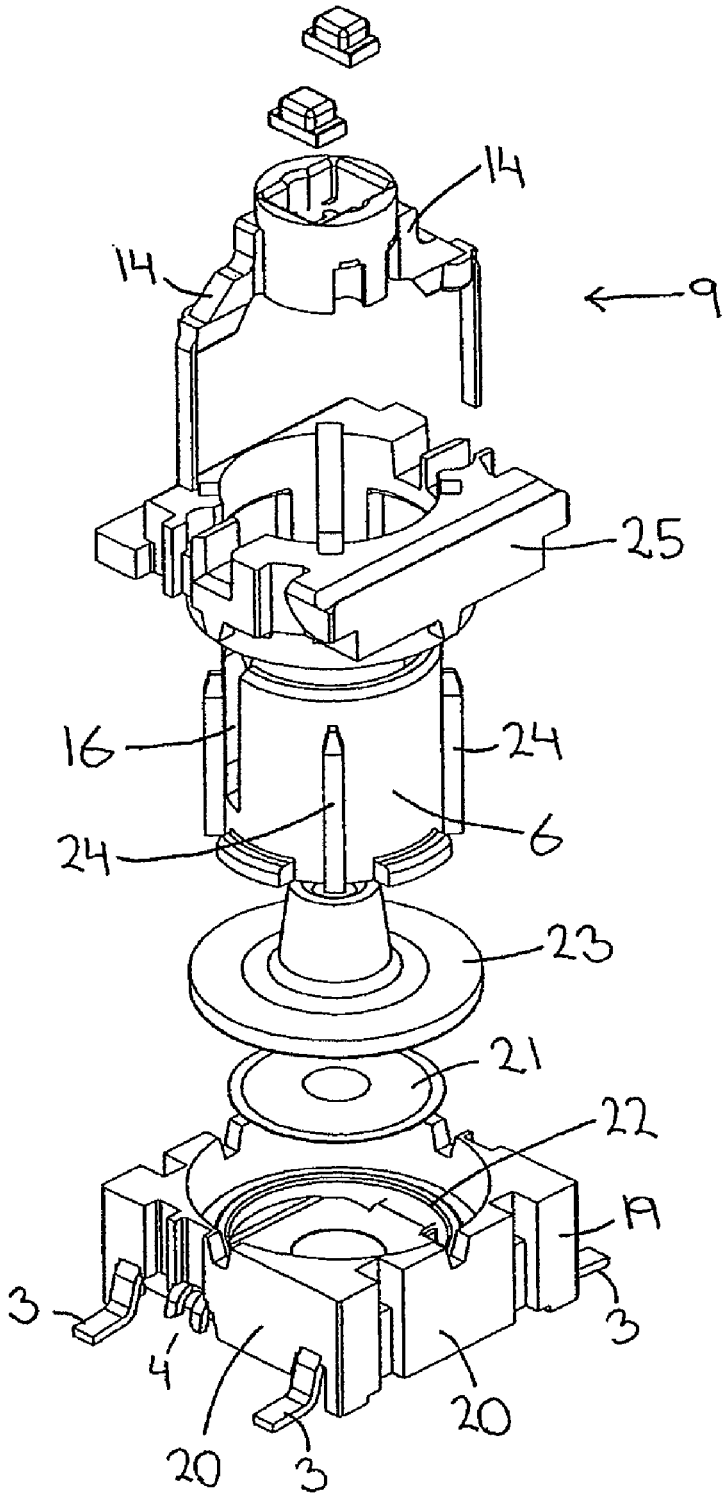
FIG. 5 is an exploded view of a presently preferred embodiment of the invention.

FIG. 5 is an exploded view of a preferred embodiment of the invention. The switch body comprises a housing 19 preferably made from an insulating material cast around a terminal unit (not shown) comprising terminal components 3, each extending outwards from an outer side wall 20 of the housing 19, and terminal points 4. The terminal unit further comprises electric contact members (not shown) for electrical contact to a switching element 21, such as a contact dome. The housing 19 of the switch body has a recess 22 for receiving the switching element 21 and providing a packing surface for a rubber component 23, such as a silicone dome. These two elements 21, 23 are placed in guided contact with the housing 19. The switchable element 21 is switchable between a first state in which it is out of electrically conductive contact with at least one of the electric contact members (not shown), and a second state in which the switching element establishes electrically conductive contact between the electrical contact members. An actuate-able key 6 is placed on top of the silicone dome 23. The key 6 has slits 16 that enable actuation of the key 6 also when the diode unit 9 is mounted with the projections 14 extending through the slits 16. The key 6 has guides 24 for correct positioning of a cover 25 of the switch body. The cover 25 is fastened to the housing 19 e.g. by ultrasound welding or gluing. The figure illustrates a possible design of complementary surfaces of the switch body and the diode unit. However, any design that prevents the diode unit 9 from movement in a predefined plane in relation to the switch body is covered by the scope of the invention.

In a switch according to the present invention each terminal point 4 of the switch body 2 is electrically connected to one of the terminal components 3 of the switch body 2. Since the terminal points 4 are connected to the diode unit terminals 15 during mounting, the electric connection to the diode(s) 13 is established when the four terminal components 3 of the switch body 2 are mounted to e.g. a key board panel. Hereby the need for establishment of additional electrical connections to the diode(s) is eliminated.

The switch as described above can be used in accordance with Surface Mounting Technique (SMT). However, other manufacturing methods may also be applied within the scope of the invention.

In a preferred embodiment of the invention, the diode socket 10 and the switch housing 19 are produced by casting an insulating material around the terminals. However, it may also be possible to cast the insulating components separately and mount the terminal components thereto afterwards, e.g. by gluing.

The invention claimed is:

1. A method of mounting a diode unit including at least one diode and a pair of terminals on a switch having an actuate-able key and a switch body with at least two terminal points, comprising:

positioning the diode unit on an exposed end of the key wherein the exposed end of the key comprises a peripheral wall surrounding a recess, the diode unit is arranged within the recess, the diode unit terminals extending through openings or slits formed in said peripheral wall, and surface parts of the diode unit engage with corresponding surface parts of the switch body to prevent the diode unit from movement in relation to the switch body in a predefined plane, extending the diode unit terminals in a direction transverse to said plane, and connecting the diode unit terminals to the terminal points of the switch body to prevent movement of the diode unit in relation to the switch body transversely to said plane.

2. The method according to claim 1, wherein the at least one diode is mounted in a socket having projections including said diode unit terminals, said projections being arranged to extend through said openings or slits formed in the peripheral wall of the key.

3. The method according to claim 1, wherein the connecting of the diode unit terminals to the terminal points comprises:

mechanically interconnecting the diode unit terminals and the terminal points, and soldering a connection between the diode unit terminals and the terminal points.

4. The method according to claim 1, wherein each terminal point comprises a pair of slightly mutually spaced terminal pins, and said connecting of the diode unit terminals comprises positioning each diode unit terminal between a respective pair of said terminal pins and pressing the terminal pins together around the diode unit terminals.

5. The method according to claim 1, wherein connecting the diode unit terminals to the terminal points of the switch body comprises electrically connecting the diode unit terminals and the terminal points of the switch body.

6. A switch, comprising:

a switch body having at least two terminal points, an actuate-able key mounted on said switch body, and a diode unit including at least one diode and a pair of terminals mounted on an exposed end of the key, wherein:

the exposed end of the key comprises a peripheral wall surrounding a recess, the diode unit is arranged within the recess, the diode unit terminals extending through openings or slits formed in said peripheral wall, and surface parts of the diode unit engage with corresponding surface parts of the switch body to prevent the diode unit from movement in relation to the switch body in a predefined plane, and the diode unit terminals extend in a direction transverse to said plane and are connected to the terminal points of the switch body so as to limit relative motion of the diode unit and the switch body in at least a transverse direction with respect to the predefined plane.

7. The switch according to claim 6, wherein the at least one diode is mounted in a socket having projections including said diode unit terminals, said projections being arranged so as to extend though said openings or slits formed in the peripheral wall of the key.

8. The switch according to claim 6, wherein each terminal point comprises a pair of slightly mutually spaced terminal pins, each diode unit terminal being positioned and pinched between a respective pair of said terminal pins.

9. The switch according to claim 6, wherein said engaging surface parts of the diode unit and the switch body, respectively, comprise substantially complementary surface parts.

10. The switch according to claim 6, wherein the switch body further comprises at least four terminal components extending outwards from one or more outer side wall(s) of the switch body, at least two of the terminals each being electrically connected to a respective terminal point.

11. A method of mounting a diode unit including at least one diode and a pair of terminals on a switch having an actuate-able key and a switch body with at least two terminal points, comprising:

positioning the diode unit on an exposed end of the key wherein-the exposed end of the key comprises a peripheral wall surrounding a recess, the diode unit is arranged within the recess, the diode unit terminals extending through openings or slits formed in said peripheral wall, and surface parts of the diode unit engage with corresponding surface parts of the switch body to prevent the diode unit from movement in relation to the switch body in a predefined plane, extending the diode unit terminals in a direction transverse to said plane, and connecting the diode unit terminals to the terminal points to prevent movement of the diode unit in relation to the switch body transversely to said plane, wherein each terminal point comprises a pair of slightly mutually spaced terminal pins, and said connecting of the diode unit terminals comprises positioning each diode unit terminal between a respective pair of said terminal pins and pressing the terminal pins together around the diode unit terminals.

12. A switch, comprising:

a switch body having at least two terminal points, an actuate-able key mounted on said switch body, and a diode unit including at least one diode and a pair of terminals mounted on an exposed end of the key, wherein:

the exposed end of the key comprises a peripheral wall surrounding a recess, the diode unit is arranged within the recess, the diode unit terminals extending through openings or slits formed in said peripheral wall, surface parts of the diode unit engage with corresponding surface parts of the switch body to prevent the diode unit from movement in relation to the switch body in a predefined plane, and the diode unit terminals extend in a direction transverse to said plane and are connected to the terminal points, and each terminal point comprises a pair of slightly mutually spaced terminal pins, each diode unit terminal being positioned and pinched between a respective pair of said terminal pins.

* * * * *